US007742366B2

(12) United States Patent
Haas

(10) Patent No.: US 7,742,366 B2
(45) **Date of Patent: *Jun. 22, 2010**

(54) ONE PIECE SELF-EXPIRING SECURITY BADGE OR LABEL WITH DEVICES TO PRINT, ACTIVATE AND ISSUE THE TIME-LABEL AUTOMATICALLY

(75) Inventor: David J. Haas, Suffern, NY (US)

(73) Assignee: Tecco, Inc., Suffern, NY (US)

( * ) Notice: Subject to any disclaimer, the term of this patent is extended or adjusted under 35 U.S.C. 154(b) by 413 days.

This patent is subject to a terminal disclaimer.

(21) Appl. No.: 11/895,614

(22) Filed: Aug. 24, 2007

(65) Prior Publication Data

US 2009/0052285 A1 Feb. 26, 2009

Related U.S. Application Data

(63) Continuation-in-part of application No. 11/325,052, filed on Jan. 5, 2006, now Pat. No. 7,263,037.

(51) Int. Cl.
*G04B 17/00* (2006.01)

(52) U.S. Cl. ..... 368/327; 116/200; 116/206

(58) Field of Classification Search ..... 368/327; 116/200–201, 207, 217, 300, 206
See application file for complete search history.

(56) References Cited

U.S. PATENT DOCUMENTS 4,236,156 A 11/1980 Eden
4,432,630 A 2/1984 Haas
4,542,982 A 9/1985 Haas
4,605,246 A 8/1986 Haas (Continued)

OTHER PUBLICATIONS

PCT International Search Report, PCT/US2008/009499 citing the above cited US Patent Application Publications.

*Primary Examiner*—Vit W Miska
*Assistant Examiner*—Sean Kayes
(74) *Attorney, Agent, or Firm*—Michael E. Zall

(57) ABSTRACT

A self-expiring badge or label that includes an upper substrate having an upper surface and a lower surface and an adhesive activator layer on the lower surface. A protective layer having a first surface and a second surface is provided, with the first surface of the protective layer being removably attached to and overlaying the adhesive layer. A lower substrate is provided that has an upper surface and a lower surface, the upper surface being removably attached to and overlaying the second surface of the protective layer. A migrating ink pattern is on the lower surface of the lower substrate. To activate, the upper substrate and at least a portion of the lower substrate are removed from the protective layer to leave a remaining portion of the lower substrate having the migrating ink pattern thereon. The migrating ink pattern is then contacted with the exposed adhesive activator layer to activate the migrating ink pattern to migrate through the adhesive activator layer and upper substrate in a selected time interval for viewing from the upper surface of the upper support layer to indicate an expired badge or label. Preferably the migrating ink pattern is contacted with the adhesive layer by folding it onto the adhesive layer. Optionally, to activate the badge both substrates are completely removed from the protective layer and the migrating ink pattern is contacted with the adhesive layer.

4 Claims, 11 Drawing Sheets

U.S. PATENT DOCUMENTS

D286,894 S 11/1986 Haas
4,779,120 A 10/1988 Haas
4,903,254 A 2/1990 Haas
4,922,689 A 5/1990 Haas
4,925,716 A 5/1990 Haas
5,058,088 A 10/1991 Haas
5,364,132 A 11/1994 Haas
5,397,881 A 3/1995 Mannik
5,446,705 A 8/1995 Haas
D365,294 S 12/1995 Haas
5,602,804 A 2/1997 Haas
5,633,835 A 5/1997 Haas
5,633,836 A * 5/1997 Langer et al. ..... 368/327
5,640,742 A 6/1997 White et al.
D386,215 S 11/1997 White et al.
D386,793 S 11/1997 Haas
5,699,326 A 12/1997 Haas
5,715,215 A 2/1998 Haas
5,719,828 A 2/1998 Haas
D394,675 S 5/1998 Haas
5,755,175 A 5/1998 White et al.
5,785,354 A 7/1998 Haas
5,822,280 A 10/1998 Haas
5,862,101 A 1/1999 Haas
5,873,606 A 2/1999 Haas
5,874,155 A 2/1999 Gehrke et al.
5,890,101 A 3/1999 Schaefer, Jr. et al.
5,901,272 A 5/1999 Schaefer, Jr. et al.
5,930,206 A 7/1999 Haas
5,932,869 A 8/1999 Gottlich
5,947,369 A 9/1999 Frommer et al.
5,957,458 A 9/1999 Haas
D415,521 S 10/1999 Haas
D415,793 S 10/1999 Haas
5,968,301 A 10/1999 Murakami
5,974,003 A 10/1999 Pedicano et al.
5,993,957 A 11/1999 Kobayashi
D419,184 S 1/2000 Haas
D419,594 S 1/2000 Haas
D419,595 S 1/2000 Haas
D419,596 S 1/2000 Haas
D420,044 S 2/2000 Haas et al.
D420,045 S 2/2000 Haas
D420,698 S 2/2000 Haas
D421,271 S 2/2000 Haas
D421,623 S 3/2000 Haas
6,086,971 A 7/2000 Haas
6,197,396 B1 3/2001 Haas
D445,127 S 7/2001 Haas
D445,128 S 7/2001 Haas
D445,129 S 7/2001 Haas
6,295,252 B1 9/2001 Holt et al.
D460,783 S 7/2002 Haas
6,446,865 B1 9/2002 Holt et al.
6,452,873 B1 9/2002 Holt et al.
D466,929 S 12/2002 Haas
D467,269 S 12/2002 Haas
D467,271 S 12/2002 Haas
D467,272 S 12/2002 Haas
D467,965 S 12/2002 Haas
D468,769 S 1/2003 Haas
6,513,710 B1 2/2003 Haas
D474,235 S 5/2003 Haas
D477,359 S 7/2003 Haas
6,614,728 B2 9/2003 Spevacek
6,752,430 B2 6/2004 Holt et al.
6,801,477 B2 10/2004 Braunberger
6,908,241 B1 6/2005 Roth et al.
6,916,130 B1 7/2005 Holt et al.
7,139,226 B2 11/2006 Haas
7,215,604 B2 5/2007 Haas
7,263,037 B2 8/2007 Haas
2002/0105183 A1 8/2002 Holt et al.
2002/0113373 A1 8/2002 Haas
2002/0147437 A1* 10/2002 McLaughlin et al. ..... 604/389
2004/0013839 A1 1/2004 Ko et al.
2005/0289345 A1 12/2005 Haas
2007/0145122 A1 6/2007 Haas
2007/0153641 A1 7/2007 Haas
2007/0158409 A1 7/2007 Haas
2008/0044310 A1 2/2008 Haas
2009/0001708 A1 1/2009 Haas

* cited by examiner

ONE PIECE SELF-EXPIRING SECURITY BADGE OR LABEL WITH DEVICES TO PRINT, ACTIVATE AND ISSUE THE TIME-LABEL AUTOMATICALLY

RELATED APPLICATIONS

This is a Continuation-In-Part of U.S. Ser. No. 11/325,052, filed on Jan. 5, 2006 now U.S. Pat. No. 7,263,037 issued on Aug. 28, 2007, the entire disclosure of which is incorporated herein by reference.

BACKGROUND OF THE INVENTION

1. Field of the Invention

This invention relates to a one piece self expiring security badge, label, ticket and pass. More particularly, this invention is directed to a one-piece self-expiring security badge or label that is thin and flexible wherein the badges or labels can easily pass through a laser or thermal printer, and can be easily stored in a roller form. Additionally, this invention relates to an improved construction of a color changing time label which enables a computer printer to print and activate the time label before issuing from the printer.

2. Related Art

Self-expiring security badges or labels have as their core technology a chemical color-changing process that can be easily activated at a specific time. Security badges are only one of the many applications for such technology. Generally, such products are useful because the color changing process is easily activated and after a predetermined period of time has passed and the color changing process is completed, they cannot be used again. Such products have found wide acceptance due primarily to their 'ease of use'. Such technologies are described in the prior art Haas, Holt and Pedicano patents listed herein and are incorporated herein by reference.

Generally, such color changing process is activated by overlaying and adhesively bonding two substrates to each other. Prior to activation the substrates are kept separate. Typically, the top or exposed substrate is an adhesive label and the bottom substrate has a migrating ink or dye on or within its face. When bonded together, the adhesive from the top label dissolves the dye in the migrating ink, causing it to bleed (diffuse) 'through' the top label at a controlled rate. After a predetermined period of time, the dye-colored image is displayed through the front of the top material and can be seen by those viewing the badge or label. Such badge or label is thus expired, i.e., "self expired" and cannot be used again.

Generally, such known self-expiring badges and labels are initially in two separate pieces, i.e., the top adhesive label and bottom dye or ink containing substrate, and are assembled at the time of issuance, i.e., activation. Because the two substrates are dry materials, they have very long shelf-lives, making these products very commercially practical. However, where there is a high volume of badges or labels issued by, for example, receptionists and security guards the two part construction proves to be inconvenient and labor intensive. There is a need for a simpler badge or label that requires less labor to activate.

Several preassembled constructions have been developed, see for example U.S. Pat. No. 5,107,470 to Pedicano et al. In this type constructions, the top substrate and bottom substrate are joined together with a paper liner interleaved between the adhesive on the top substrate and the bottom substrate containing the migrating ink. When the security badge is issued, the issuer separates the two parts by lifting the top substrate and pealing away the interleaving paper liner from the top substrate. This exposes the adhesive underlying the top substrate so that when the two parts are pressed together the top substrate adhesively bonds to the bottom substrate activating the color changing process, i.e., dissolving the migrating ink. This preassembled construction is simpler and more convenient to use, i.e., it is "user friendly." Such preassembled badges or labels also minimize one of the primary weaknesses of the two part constructions which is the failure of a receptionist or security guard to activate the product when it is issued. This is a common occurrence with badges or labels that come in two separate parts, generally because the receptionist or security guard is untrained or careless in distributing and activating such badges or labels.

However, such preassembled badges or labels as exemplified by Pedicano, have several technical problems. First, such preassembled security badges or labels as well as the two piece badges or labels each have a waste liner that needs to be removed and disposed of. If, for example, there are a large number of visitors to a facility, such waste liners can be a substantial nuisance and housekeeping problem, particularly if not disposed of properly. The liners typically have a silicone coating on one side, are slippery and collect static electricity, causing collection problems. Second, such preassembled badges or labels are stiff and rigid because they are constructed from multiple ply layers. For example, a two piece pre-activated badge or label has a top adhesive substrate with three layers, a face stock layer, an adhesive layer and a liner, while the preassembled construction badge or label consists of five layers: a face stock, an adhesive layer, a removable liner barrier, a bottom-substrate face stock, and a bottom-substrate liner. In order to store such badges or labels, they need to be fan folded. Fan folded badges or labels typically lays in stacks about 2-3 inches high and are folded every two or three badges or labels. This requires that the stacks of badges or labels be outside the computer printer and occupy substantial desk space. Since most security badges are issued from a small receptionist desk in the lobby where surface area is at a premium, it is important to employ security badge printers and badge supplies that have as small a footprint as possible. If the fan folded badges or labels were folded every four badges or labels, they stack of badges or labels would be 12 inches long, protruding from the rear of the thermal printer. This is inconvenient and impractical.

The applicant is aware of the following prior art (U.S. patents):

| |
|---|
| 3,520,124 to Myers |
| 4,408,557 to Bradley et al |
| 4,903,254 to Haas |
| 5,058,088 to Haas et al |
| 5,446,705 to Haas et al |
| 5,602,804 to Haas |
| 5,633,835 to Haas et al |
| 5,633,836 to Langer et al |
| 5,667,303 to Arens |
| 5,699,326 Haas et al |
| 5,715,215 to Haas et al |
| 5,719,828 to Haas et al |
| 5,822,280 to Haas |
| 5,930,206 to Haas et al |
| 5,974,003 to Pedicano et al |
| 6,270,122 to Shadle |
| 6,295,252 to Holt et al |
| 6,452,873 to Holt et al |
| 6,641,691 to Shadle et al |
| 6,741,523 to Bommarito |
| 6,752,430 to Holt et al |
| 6,916,130 to Holt et al |

Still further, time labels which change color by a dye diffusion color changing mechanism were first invented in 1980. They have been successfully used for one-time-use security badges and non-reusable indicators of various sorts for many years. In every commercially product, the time label is activated to start the time controlled color changing process by manually applying a self-adhesive front label (front part) onto a back portion label (back part) that is printed with a molecular dye based migrating ink. Upon contact of the pressure sensitive adhesive with the migrating ink, the dye from the ink diffuses into the adhesive to cause the color change. Based on the adhesive composition and the particular dye, the color of the front part label changes to show expiration.

Even though the time labels may be computer printed by many types of computer printers, such as ink jet, direct thermal, thermal transfer, etc, the printed label is manually removed directly from the computer or from a roll of previously printed labels and activated by hand in order to begin the color-changing process. This manual issuing of security badges and/or time labels is a major problem for users. There are a number of benefits for having a printer automatically activate the time label before issuing. There are even more benefits to have an unmanned kiosk in a lobby (facility) or unmanned printer issued activated time labels direct to the end-user. Previous attempts to perform this automatic time label activation have failed.

Previous attempts to produce a printer-activated-time-label system failed because of the relative complexity of the printers. Also, different chemical activation mechanism have been attempted, but none of them have become commercial products. To the best of Applicant's knowledge, the only time labels in use are of the dye diffusion type activated by adhesive contact with the migrating ink dye.

For example, for a system which uses two different labels combining in the printer itself, two label streams are needed and it is difficult to apply a front label onto a back label because of alignment problems, removing the front label from its liner and applying it to the back part label, training users to reload the printer and removing jams within the printer.

Another possible technique is to create a multiple layer time label that is heated to initiate the color changing process. This active chemical process or thermal barrier process where a chemical barrier is breached by heating at the time of activation, appears to be difficult to produce without pin holes in the barrier layers and to control the dye diffusion elements.

Another process may be to produce a time label with micro-encapsulated elements that are initiated by mechanical crushing in the printer by passing the time labels through crushing rollers. This process requires the development of very stable encapsulated materials that are resistant to environmental heat and storage.

Another process may be to produce a multilayer thermal transfer ribbon which initiates the color changing process upon heat transfer of the materials. This process would also require the development of a printable time label in order to be printed as well as receive the color changing materials from the thermal ribbon. One can conceive of a variety of thermal ribbon coatings and combinations of chemicals which can be transferred to a label substrate in order to produce a color changing process.

Still another mechanism would be to employ a liquid activator which is applied to the time labels as they pass through the printing device. Applying the liquid would initiate the movement of the dyes through the opaque white barrier hiding the colored dyes so that the expiring image will be produced on the face of the time label.

None of these systems appears to have been practical.

Because of the technical difficulties and complicated constructions of all these chemical and multiple part mechanical schemes, none of them have proved practical for commercial products. The current invention has overcome all these difficulties by employing a single piece label structure exactly like standard paper labels and standard direct thermal computer printable labels which have a simple construction and have been well proven to be practical. The activation mechanism is by a simple mechanical rearrangement of the label components during or after printing the label with a computer printer. Hence, this simple mechanical rearrangement requires only simple mechanical components in a printing device.

OBJECTS AND SUMMARY OF THE INVENTION

It is an object of this invention to provide a one-piece self expiring badge, label, ticket or pass.

It is a further object of this invention to provide a one-piece self expiring badge, label, ticket or pass that has a minimal number of waste liners that need to be disposed of after activation.

It is another object of this invention to provide a one-piece self expiring badge, label, ticket or pass that is thin, flexible and can be easily stacked, stored and rolled.

Another object of the invention is to provide a one-piece self expiring badge, label, ticket or pass that can easily pass through a laser or thermal printer.

It is a further object of this invention to provide time labels which change color after a predetermined time interval after activation for high security use by guaranteeing one-time use.

It is another object of this invention to provide time labels which change color after a predetermined time interval after activation which can be automatically issued or dispensed to the individual by simply reading electronically the individuals personal identification ID card, visa card, alien card, or any other "trusted" governmental issued ID card.

It is an object of this invention to provide time labels which change color after a predetermined time interval after activation without an operator or human intervention. It is an object of this invention to provide time labels which change color after a predetermined time interval after activation with only the blank time labels themselves as expendable components.

It is an object of this invention to provide time labels which change color after a predetermined time interval after activation within seconds of demand by computer printing.

It is an object of this invention to provide time labels which change color after a predetermined time interval after activation of various sizes, shapes, and color expiration patterns.

It is an object of this invention to provide time labels which change color after a predetermined time interval after activation which can be issued by hand or by an automatic dispenser.

It is an object of this invention to provide time labels which change color after a predetermined time interval after activation which do not produce chaff and litter.

It is an object of this invention to provide time labels which change color after a predetermined time interval after activation that can be printed, activated & issued in one step It is an object of this invention to provide time labels which change color after a predetermined time interval after activation that can be issued with the liner removed (exposed adhesive ready to apply to ones clothing)

It is an object of this invention to provide time labels which change color after a predetermined time interval after activation that permit years of shelf-life to the supply label stock and the printers loaded with labels for infrequent use It is an object of this invention to provide time labels which change color after a predetermined time interval after activation which requires no heater adjustments or setting, no ribbons, no inkjet or toner supplies, no ambient temperature adjustments It is an object of this invention to provide time labels which change color after a predetermined time interval after activation that is tamper resistant because once the migrating ink touches the adhesive; it cannot be lifted off or stopped.

It is an object of this invention to provide time labels which change color after a predetermined time interval after activation with different times for time labels accomplished by simply supplying different time label stock.

All of the foregoing objects of this invention and others are achieved by the self-expiring badge or label of this invention. The badge or label comprises an upper substrate having an upper viewing surface and a lower surface and an adhesive activator layer on the lower surface. A protective layer having a first surface and a second surface is provided, with the first surface of the protective layer being removably attached to and overlaying the adhesive layer. A lower substrate is provided that has an upper surface and a lower surface, the upper surface being removably attached to and overlaying the second surface of the protective layer. A migrating ink pattern is on the lower surface of the lower substrate. To activate, the upper substrate and at least a portion of the lower substrate are removed from the protective layer to leave a remaining portion of the lower substrate having a portion of the migrating ink pattern thereon. The migrating ink pattern is then contacted with the exposed adhesive activator layer to activate the migrating ink pattern to migrate through the adhesive activator layer and upper substrate in a selected time interval for viewing from the upper surface of the upper support layer to indicate an expired badge or label. Preferably the migrating ink pattern is contacted with the adhesive layer by folding it onto the adhesive layer. Optionally, to activate the badge both substrates are completely removed from the protective layer and the migrating ink pattern is contacted with the adhesive layer.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

Figure 1A:
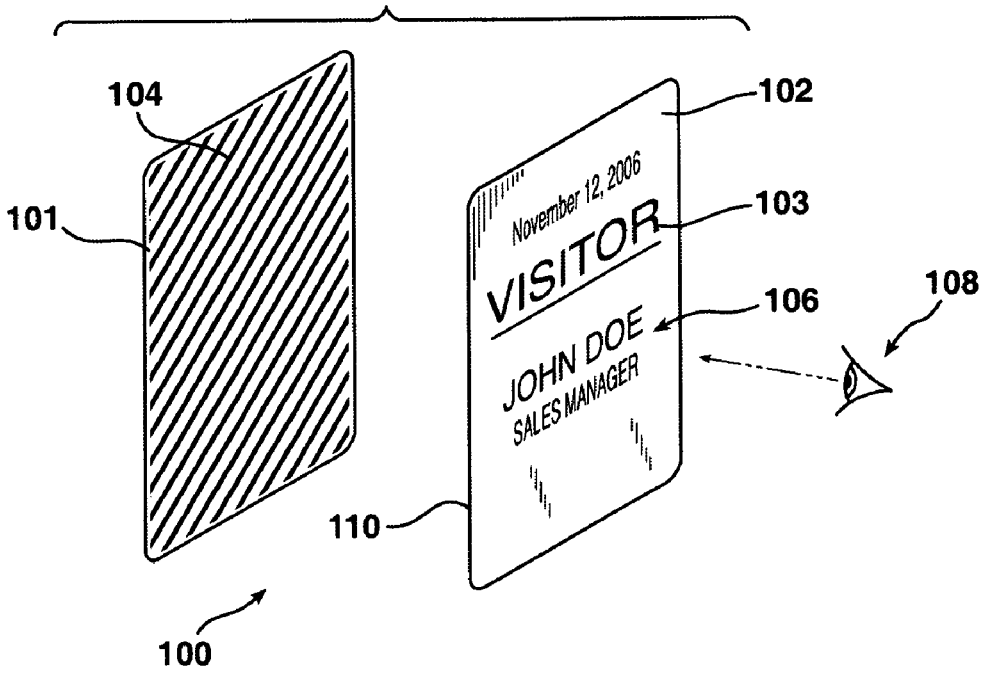
FIG. 1A PRIOR ART
FIGS. 1A and 1B is a schematic representation of prior art, self-expiring security badges or labels having a two-part construction.

FIG. 1A depicts a prior art self-expiring security badge or label 100 having a two-part construction. In this type of badge or label 100 the top substrate 102 consists of a clear substrate with a special opaque, e.g., white, adhesive coating on its back surface. The front or top surface of the top substrate 102 is typically printed with the security indicia 103 or design indicia 106 as viewed 108 from the front, and has an adhesive backing 110. The bottom substrate 101 includes a migrating ink pattern or indicia 104 printed on its front surface. When the self-expiring badge or label is activated by placing the top substrate 102 adhesive 110 in contact with the bottom substrate 101, the migrating ink 104 diffuses through the adhesive 110 and becomes visible to the observer 108 through the front face 102 of the badge or label 100. Thus, the initial opaque or white (valid) security badge 100 turns into the 'visually void' badge.

Figure 1B:
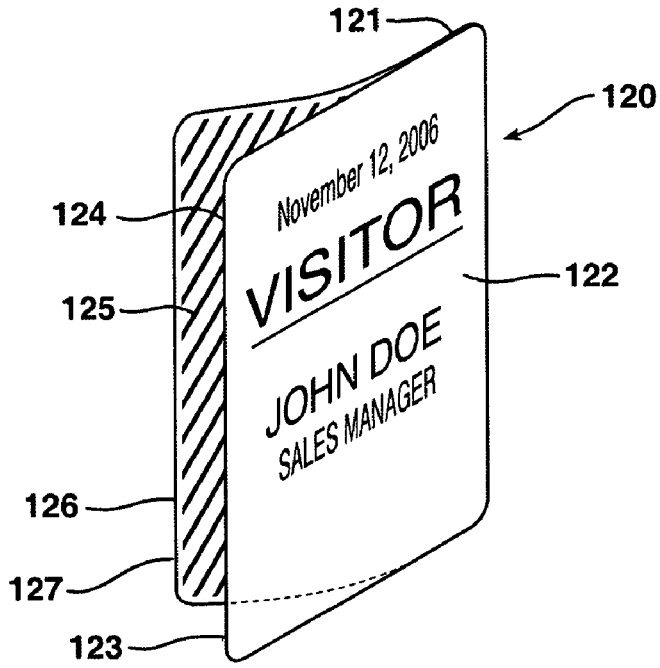
FIG. 1B PRIOR ART

An improved version of this two-part construction was developed, i.e., U.S. Pat. No. 5,107,470 to Pedicano et al. and consists of a preassembled badge or label. Referring to FIG. 1B, such preassembled badge or label 120 consists of a top substrate 122 and bottom substrate 126 which are attached to each other along one edge 121 so that only a single physical unit exits for handling. However, this preassembled badge or label 120 requires four separate layers: the top substrate label 122 with an adhesive layer 123 and a liner 124 covering the adhesive layer 123 to provide a barrier from the migrating ink indicia 125 that is on the bottom substrate 126. The front of the top substrate 122 is printed with the security indicia or design on the front surface. The bottom substrate 126 consists of a migrating ink 125 printed on the front face, an adhesive layer on the rear face, and a liner 127 covering the adhesive layer. Even though this preassembled construction is an improvement in handling and pre-aligning the top substrate 122 with the bottom substrate 126, the four material layers still present functional difficulties and cause a litter problem.

The one-piece security badge or label described and claimed herein provides a superior solution to the functional and handling difficulties of these previous preassembled constructions and additionally provides improvements in the production and use of self-expiring security badges or labels.

Figure 2A:
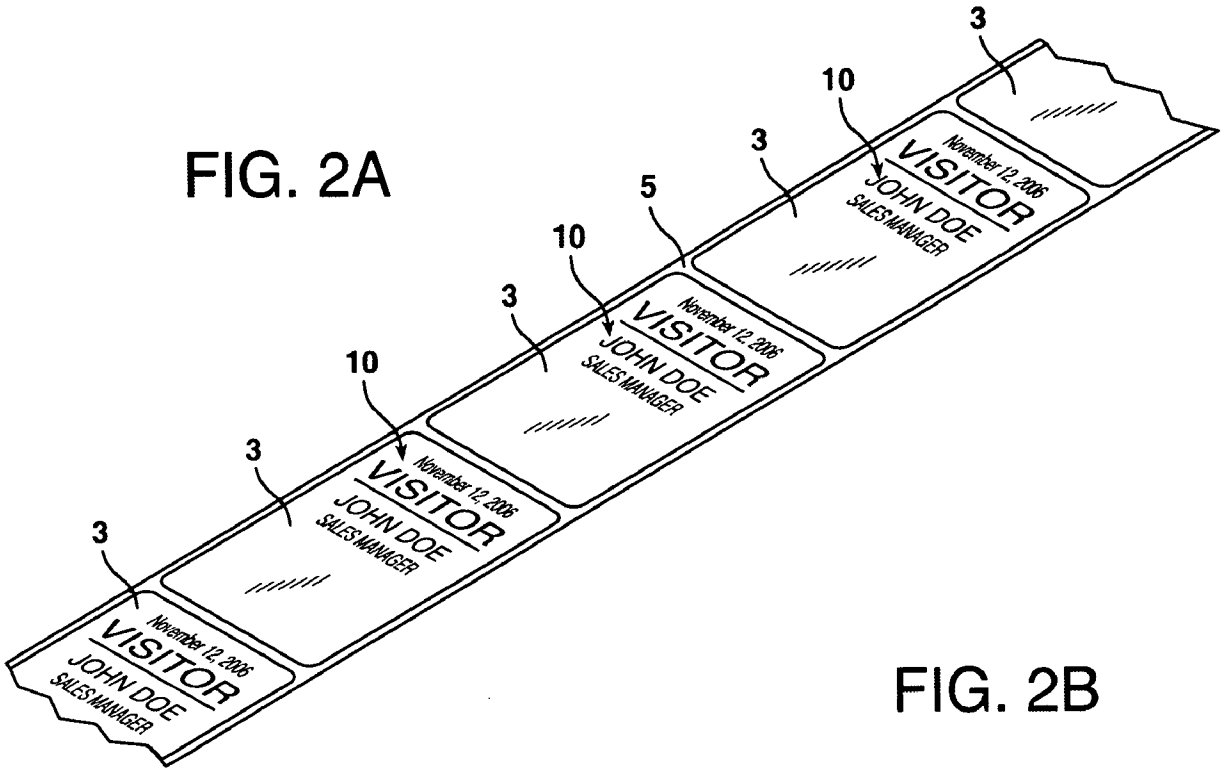
FIGS. 2A and 2B show, respectively, a perspective view and cross-sectional view of the one-piece, self-expiring badge or label of this invention prior to activation.
Figure 2B:
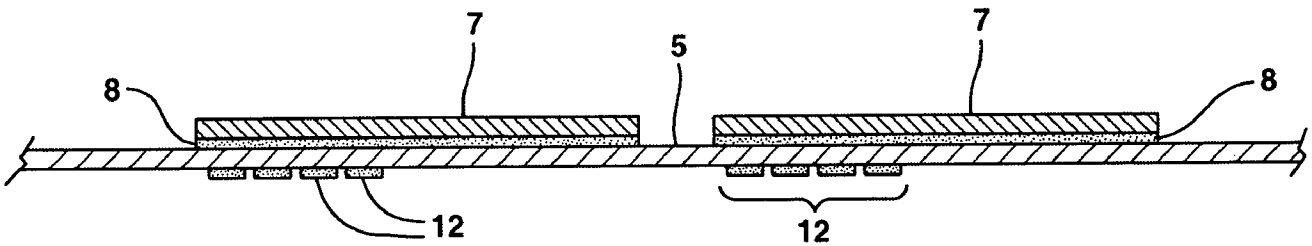

FIGS. 2A and 2B, shows the self-expiring badge or label of this invention prior to activation and as formed as a die cut label-like structure 3 on a continuous silicone liner web 5. The top substrate 7 has an identifying or security indicia 10 on the top surface thereof and an adhesive layer 8 on its underside for attaching to a display surface, e.g., clothing. The top substrate 7 is die-cut, preferably as a rectangle, on the silicone liner 5 that protects the adhesive layer 8. The self-expiring badge or label of this invention further includes a migrating ink pattern 12 printed on the backside or opposite side of the liner 5. The migrating ink pattern 12 contains a dye that migrates upon activation. The migrating ink pattern 12 and dye are inert and immobile when in contact with materials in which the dye is insoluble, e.g., the face of the top substrate 7. The migrating ink pattern 12 will not bleed when in contact with the various areas of the front or back of the web. This permits the continuous length of liner 5 containing the top substrate 7, adhesive layer 8 and migrating ink pattern 12 to be rolled up on itself. Thus, migrating ink pattern 12 is separated from the activating adhesive 8 intended for its eventual interaction. The liner 5 provides a protective barrier between the migrating ink pattern 12 and the activating adhesive 8 on the top substrate 7 of the expiring badge 3.

Figure 3A:
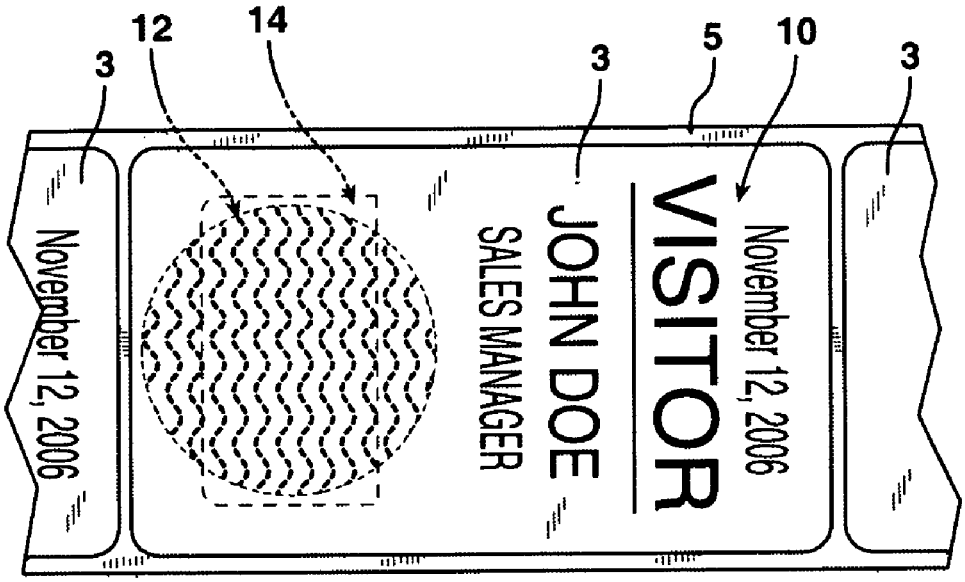
FIGS. 3A and 3B show, respectively, a top plan view and a bottom plan view of the self-expiring badge or label of this invention prior to activation.
Figure 3B:
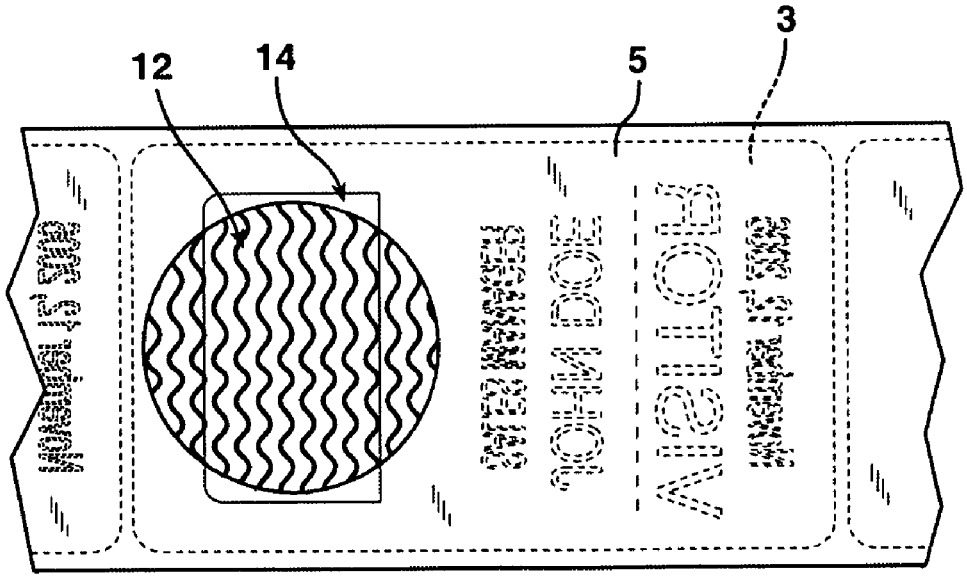

FIGS. 3A and 3B, shows, respectively, the top plan view and bottom plan view of the self-expiring badge or label of this invention prior to activation and use and as formed as a die cut label-like structure 3 on a continuous silicone liner web 5. A die cut bottom substrate 14 is cut from the liner 5 with the migrating ink 12 printed thereon. The die cut bottom substrate 14 can be any size or shape. Preferably substrate 14 is a rectangle near one end of the badge and has been die cut with few or no ties to the liner 5.

Figure 4A:
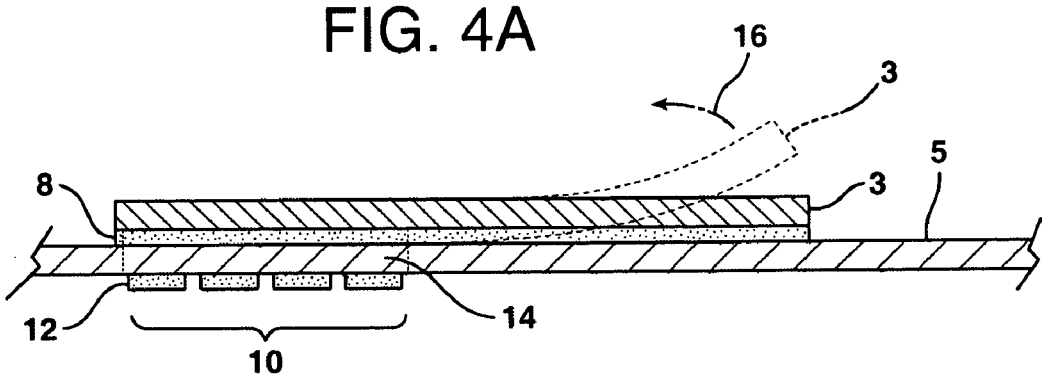
FIGS. 4A, 4B, 4C and 4D show, in a stepwise manner how the one-piece, self-expiring badge or label of this invention is activated.

FIGS. 4A through 4D show in a stepwise manner how the one-piece, self expiring badge or label of this invention is activated and used. In FIG. 4A, the top substrate (label) 3 is peeled from the liner 5 (arrow 16) exposing the adhesive layer 8 on the underside thereof. Since the die cut section 14 with migrating ink pattern 12 thereon is not attached to liner 5 it remains attached to the adhesive layer 8.

Figure 4B:
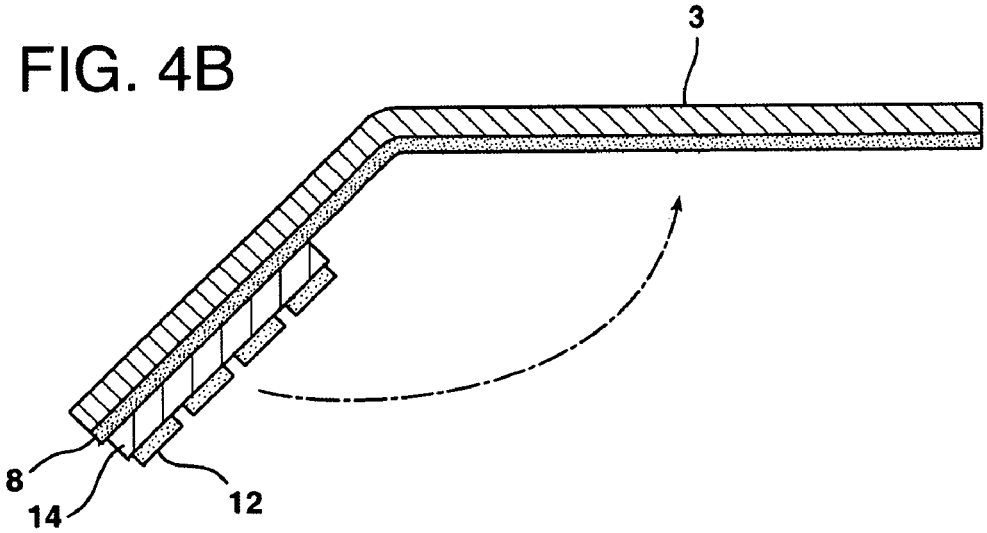
Figure 4C:
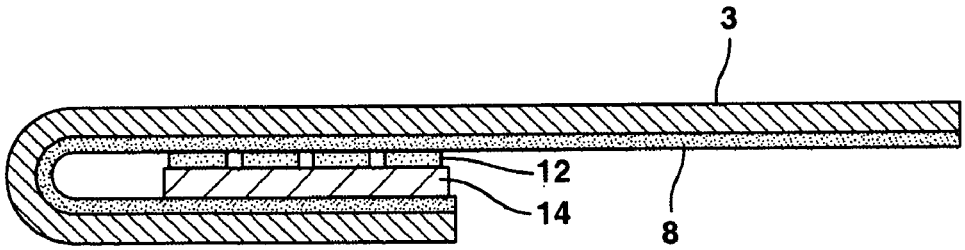
Figure 4D:
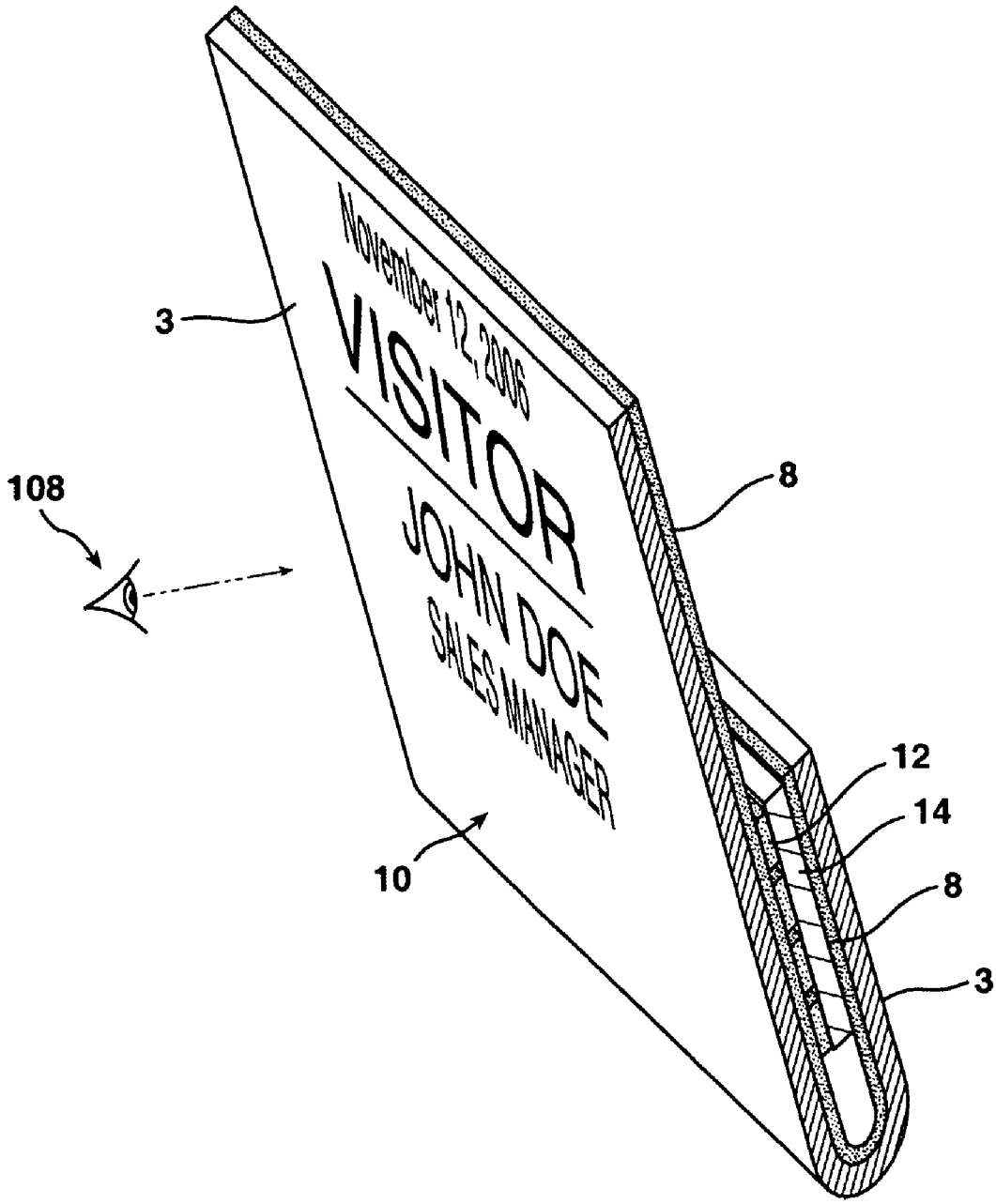

Referring to FIGS. 4B and 4C, after the label 3 of the badge is removed from the liner 5 the person issuing the badge simply folds the badge 3 near the edge of die cut bottom substrate 14 (FIG. 4B) and presses it in contact with the adhesive layer 8 (FIG. 4C). The badge is now activated and ready to issue to a person. As shown in FIG. 4D, the remaining portion of the adhesive layer 8 is used to attach the badge to a visitor's clothing. Since there are no loose silicone liner pieces to litter the work area, this one-piece badge is more user friendly. Also, the continuous webliner 5 can be rolled up and easily disposed of in a small roll. Although, FIGS. 4A-D show one means of activating the badge or label, there are several means of activating the badge or label with this new type of construction.

Figure 5A:
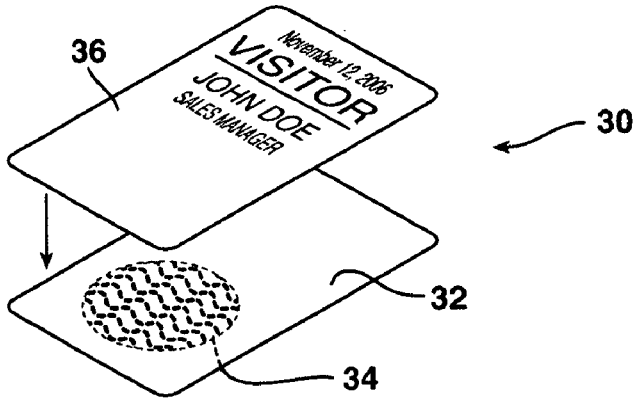
FIGS. 5A, 5B and 5C show in a stepwise manner how a second embodiment of the one-piece, self-expiring badge or label of this invention is activated.
Figure 5B:
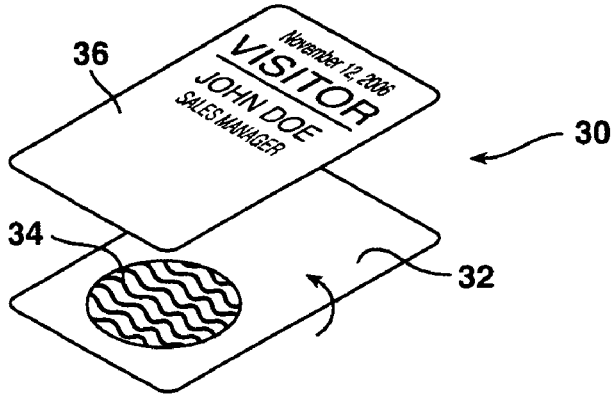
Figure 5C:
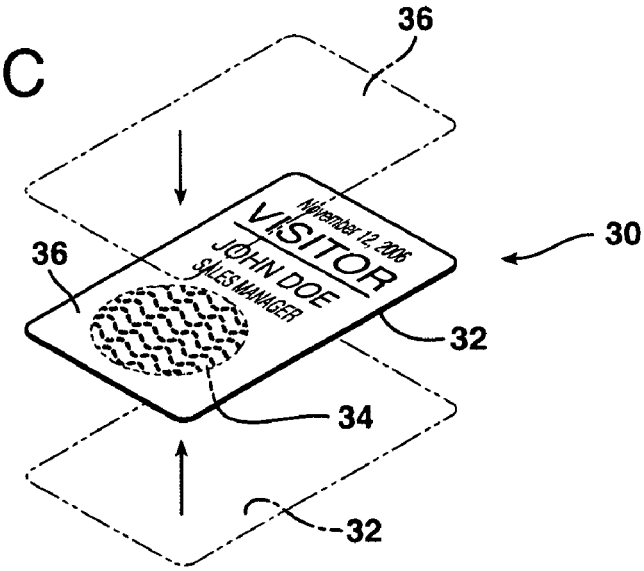

FIGS. 5A-C shows an alternate construction of the badge or label 30 of this invention. In this arrangement, inactivated badge or label 30 can have the bottom-substrate 32 removably and adhesively attached to the underside of top substrate 36. The back of the bottom substrate 36 has the migrating ink pattern 34 printed thereon. The top substrate 36 has an activating adhesive on the back thereof. In FIG. 5A, the bottom substrate 32 is fully removed from the top substrate 36 prior to issuance of the badge or label. Optionally, still referring to FIG. 5A, the bottom substrate 32 and top substrate 36 can each be removably adhered to opposite sides of a silicone web liner (not shown). In FIG. 5B the bottom substrate 32 is being inverted such that the migrating ink pattern 34 is facing the activating adhesive on the underside of the top substrate 36. In FIG. 5C the top substrate 36 and the bottom substrate 32 are pressed together, the adhesive activating the migrating ink pattern 34.

In this alternate construction of the badge or label 30, both the top and bottom substrates 36, 32 may be die cut on a silicone liner similar to the configuration shown in FIGS. 2A & 2B. The bottom substrate 32 may be circular or rectangular and may be cut to a size and shape of the migrating ink pattern 34, and it may be fully die cut from the liner or it may have small die cut ties holding it onto the liner. These ties may be useful in maintaining the bottom substrate 32 when in circle form, from becoming detached when the web is rolled tightly. Tight rolls cause the liner to flex and curl, in which case a bottom circular substrate 32 may curl and separate at its edges. Optionally, additional silicone may be coated onto the back or underside of the liner to which the bottom substrate 32 is mounted making it easier to remove the bottom substrate 32.

As shown in FIG. 5A-C when the top substrate 36 is removed from the bottom substrate 32, the issuer, e.g., guard or receptionist, merely turns it over as shown by the arrow in FIG. 5B and attaches it to the adhesive again. This activates the self-expiring badge or label, the migrating ink 34 from the bottom substrate diffusing through the top substrate 36 to become visible on the face of the top substrate 36 when the badge or label has expired after a predetermined period of time has passed.

It may also be possible to apply the migrating ink pattern 34 to the back of the liner by other means, such as applying a removable coating to the back face of the silicone liner. It also may be possible to print the migrating ink on the back of the silicone liner in such a manner that the ink can be lifted off the liner itself by simply touching the adhesive on the top substrate 32 to the migrating ink pattern printed on back of the liner, the migrating ink pattern becoming firmly attached to the adhesive and hence, the migrating ink separates from the back of the liner and is lifted onto the back substrate 36 adhesive. This permits the migrating ink pattern to become attached to the top substrate 32 without the necessity for a substrate behind the migrating ink pattern.

In all of these embodiments, prior to activation, the top substrate adhesive is separated from the migrating ink pattern by a protective layer therebetween. The migrating ink pattern remains inert until it is in contact with the adhesive on the underside of the trop substrate.

This new construction of self-expiring security badges or labels produces a dynamic self-adhesive 'label-like' product that is constructed in exactly the same manner as standard adhesive labels. By offering a self-expiring product in the same format, thickness, and flexibility as plain paper labels, the same printing equipment can be used and the users of the product do not have to be trained in handling a more complicated product with multiple layers. The benefits of this new construction are a simple face stock and liner construction with the same mechanical properties as standard label stock, pre-aligned folding edges that permit easy handling, even with one hand, no separate waste paper that creates litter, lower cost because of the simpler construction, more badges or labels on each roll to accommodate small thermal printers, rolled badges or labels instead of fan folded badges or labels.

Figure 6A:
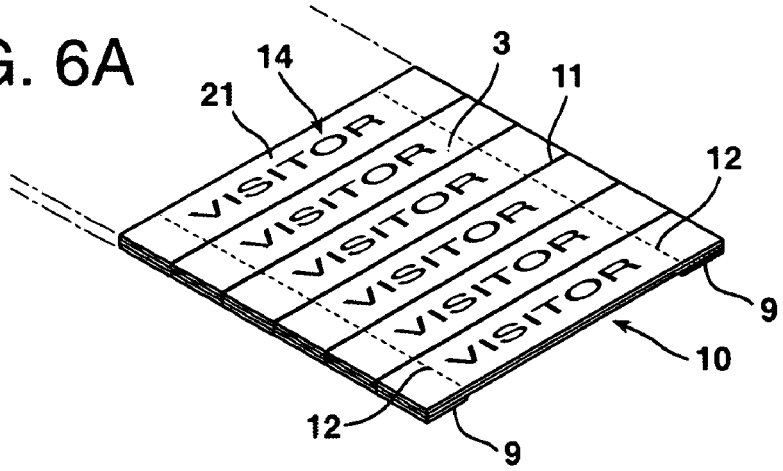
FIG. 6 shows another embodiment of the one-piece, self-expiring badge or label of this invention being activated.
Figure 6B:
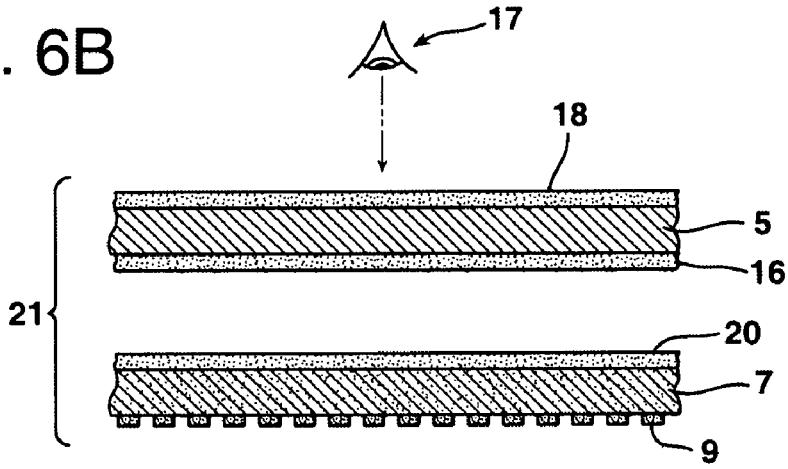
Figure 6C:
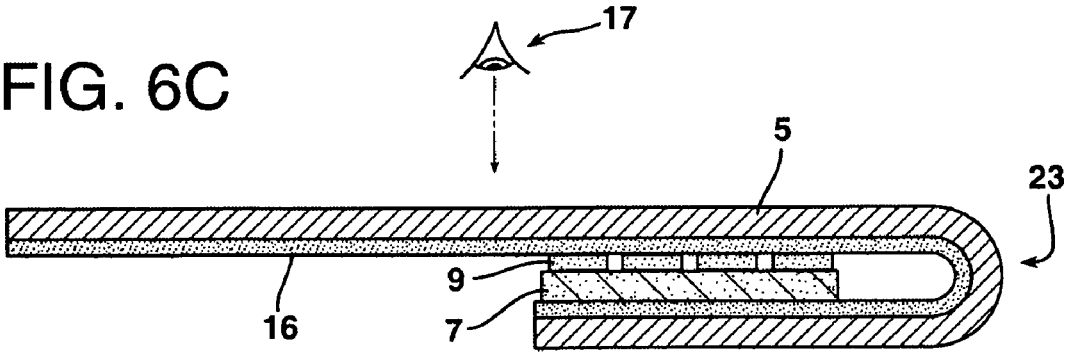
Figure 7A:
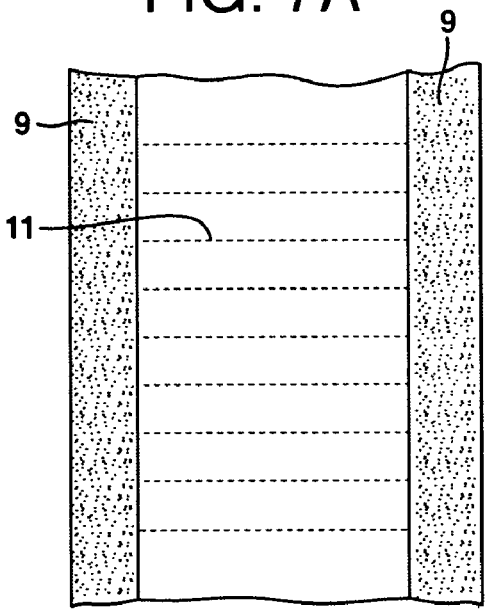
FIG. 7-9 shows the method and apparatus to print, activate and issue labels of this invention.
Figure 7B:
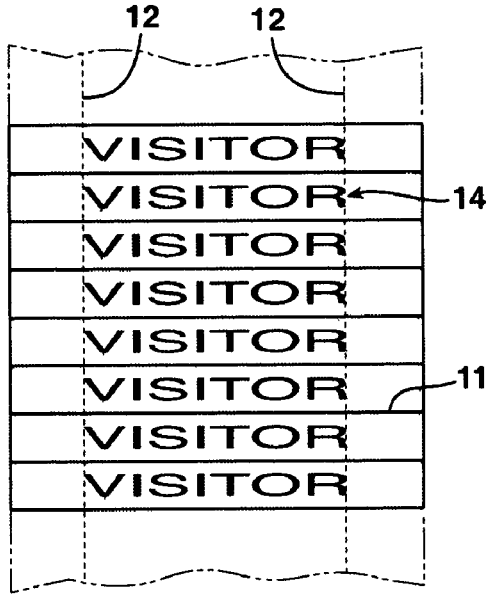
Figure 7C:
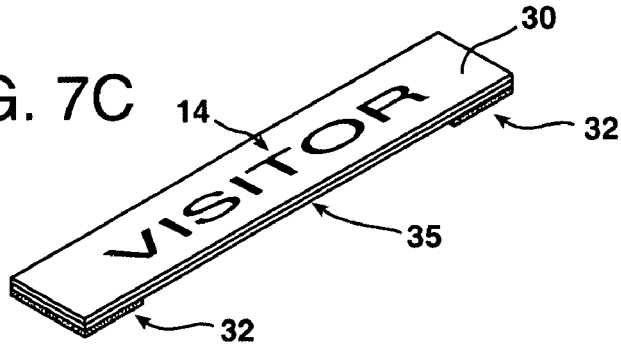
Figure 7D:
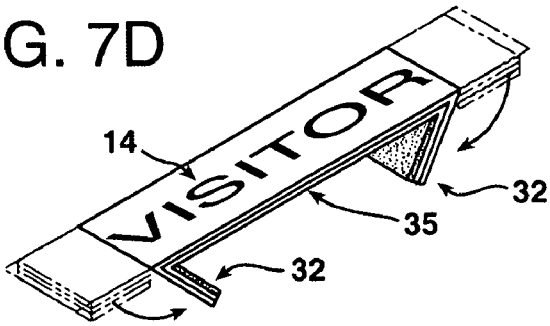
Figure 7E:
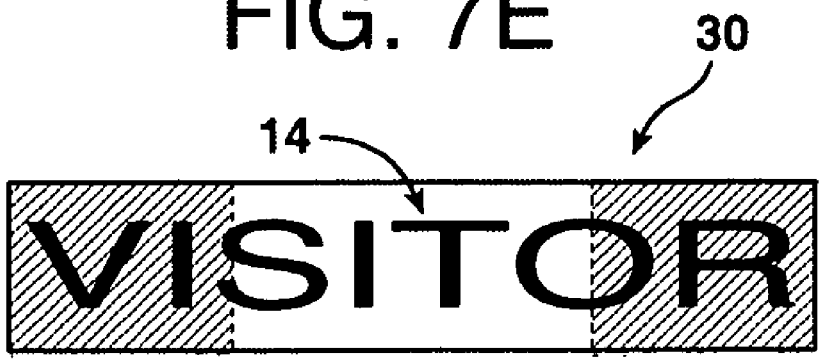

In another aspect of this invention, the time label material is an adhesive coated facestock attached to a silicone liner. As shown in FIG. 6, the facestock 3 with adhesive 16 on its lower surface is attached to the silicone liner 7. The liner 7 has slits 12 along the length of the liner that separate a portion of the liner that has been printed with migrating ink 9 and a portion that has not been printed with migrating ink 10. With lateral cuts 11 in the face stock 3 as shown in FIGS. 6A and 7A, the web of material is cut into individual labels 21. These labels can be of any size, in any direction, and the migrating ink and die cuts in the liner can also be of any form and location.

Figure 8A:
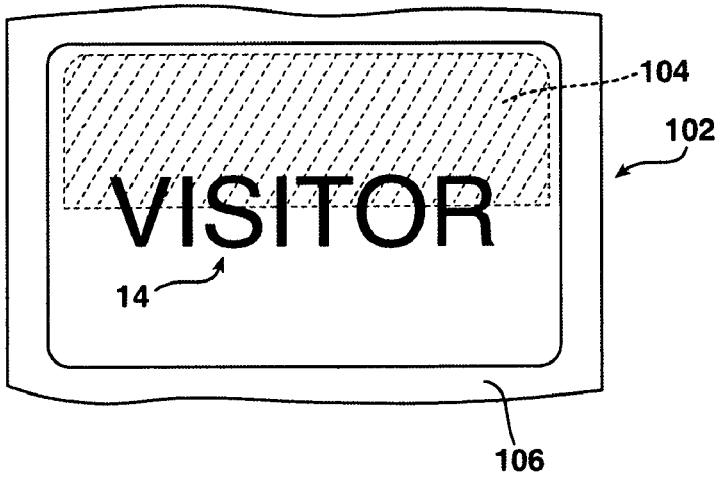
Figure 8B:
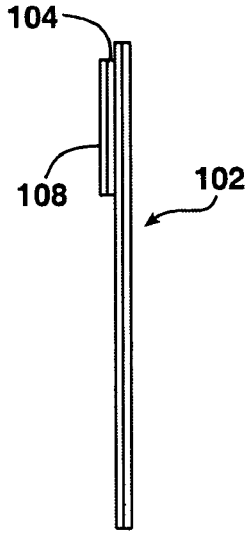

As shown in FIG. 8A, label 102 is the time label with its wide edge across the web and the liner 104 is also cut across the web so that when the label is removed, the cut portion of the liner 104 can be removed with the adhesive on the facestock. As shown in FIG. 8B, item 102 is the label removed from the web of liner 106 and the portion of the liner 104 that is die cut remains attached to the time label 102. From all these various constructions, one can see that the constructions of the label with a portion of the liner attached can be of many different forms. Time label 102 of FIG. 8B shows the cutout area of liner 104 so that the liner with the migrating ink 108 can be removed as a single unit in order not to leave individual pieces of chaff to dispose of. With two piece constructions of time labels, chaff remains behind after activation of the time label and this causes substantial nuisance and hazard problems. In all these embodiments of the invention, the time label is separated from a single web thus providing an efficient and convenient means of disposing of the waste liner.

Figure 8C:
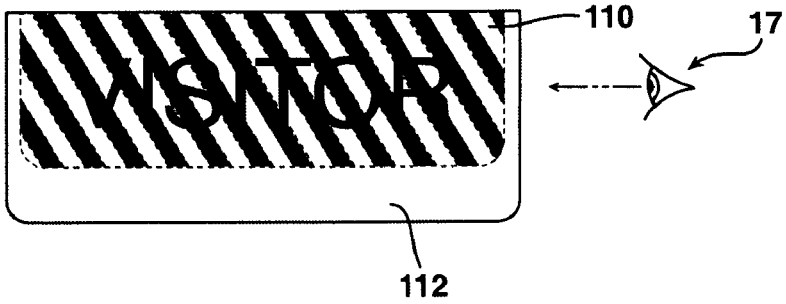

In FIG. 8C, the color changing portion of the face of the time label 112 may be along the top edge or along the bottom edge 110. This is preferred because horizontal bands are easier to see than vertical bands. Also, the printed data will generally be horizontal in these areas and thus, the color changing background will obliterate the relevant data such as the date or heading.

Continuing with the construction shown in FIG. 6, and in particular 6A and B, the construction of the web of material 21 consists of an adhesive coated facestock and a silicone coated liner. The observer 17 will view the time label from the front and see the direct thermal coating 18 which prints dark when passed through a thermal printing device. The clear substrate 5 is coated on the lower surface with adhesive 16. The liner substrate 7 is coated with a silicone release coating 20 so that the adhesive 16 can be removed without difficultly. A portion of the lower surface of the liner 7 is printed with migrating ink 9 which will provide the color changing means for the time label.

The web of material as shown in FIG. 6 can be passed through a thermal printing device so that information 14 can be printed on the front of the time label. The time labels have all have a printable facestock with a white or opaque adhesive 16 on the back surface, a liner with migrating ink 9 printed on the back surface, and a die cut liner 7 so that a portion of the liner with migrating ink can be folded along 23 and brought into contact with the adhesive from the facestock. This will cause the activation of the time label color change as the dye from the migrating ink 9 diffuses into and through the white adhesive 16 so that the color of the dye appears on the front of the time label to be seen by the observer.

FIGS. 6-9 show a variety of means of activating the time labels. In FIG. 7, the label is made symmetrical with migrating ink 9 printed on the two outer edges of the liner. Of course, an alternate construction can be made with migrating ink on only one side of the liner. The label can be lifted off the liner and folded by hand as shown in FIGS. 7 C, D, E where the label 30 is lifted off the liner and the two edges 32 can be folded over by hand and attached to the exposed adhesive 35. The two ends 32 with the migrating ink become attached to the adhesive 35 in the middle of the label so that two edges of the time label change color to show expiration after the functional use of the time label.

Figure 7F:
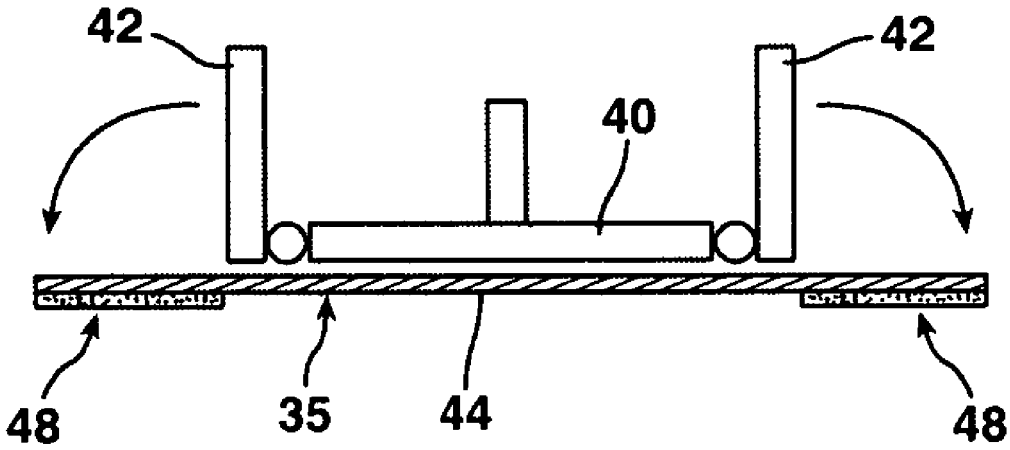

As shown in FIG. 7F, the folding operation can also be performed by any of a variety of mechanical mechanisms which could be incorporated into a thermal printer or other issuing device. A vacuum device 40 can be designed to pick up the label 44 and hold it into positron so that the folding wings 42 can rotate the migrating ink portions of the label 48 onto the adhesive 35 in order to activate the timing mechanism. Such an assembly of the time labels places the migrating ink 9 in contact with the white adhesive 35 so that after a predetermined time interval, the observer will see the color change.

This label is symmetrical and permits equal folding pressure to be applied on each side. At times this symmetrical operation is beneficial, however it may also be asymmetrical with folding on one side.

Another activation mechanism which may be useful for large time labels and single edge time labels is shown in FIG. 9. In this arrangement, the web of time labels rests on a platform 204 and is drawn over a peel edge 205 by pulling the liner 206 around the sharp edge of the peel edge 205. The labels 202 ride along the platform 204 and are peeled off the silicone liner 206, by means of the angular edge device 205. The label 202 remains partially attached to the liner 206 and is suspended in air away from the angular edge 205. A vacuum holding platen 200 attaches the time label to the flat platen surface so that the time label can be manipulated. This is done by a vacuum system which employs holes 201 in the platen itself.

Figure 9A:
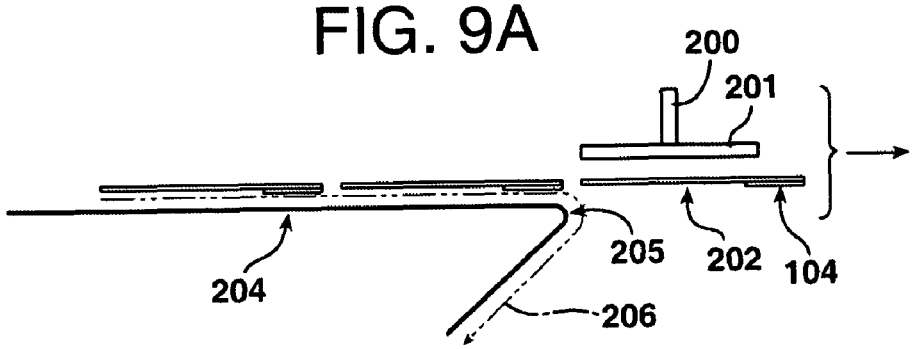
Figure 9B:
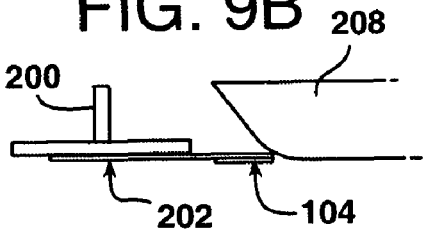
Figure 9C:
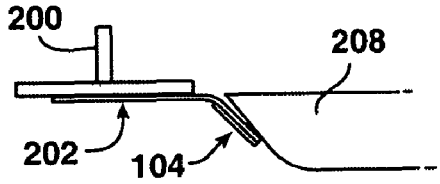
Figure 9D:
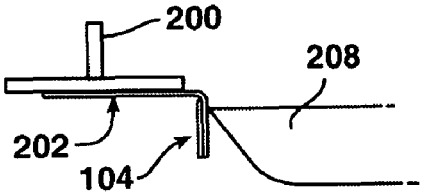
Figure 9E:
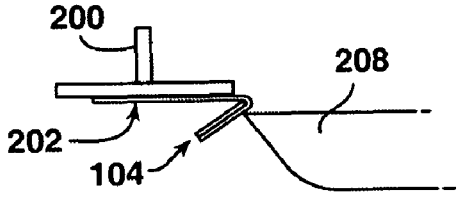
Figure 9F:
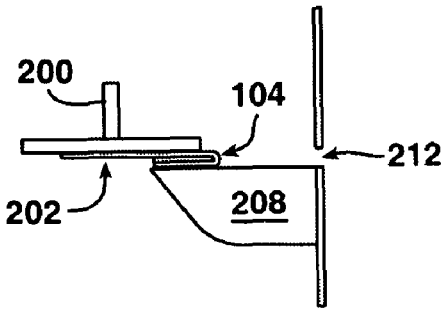
Figure 9G:
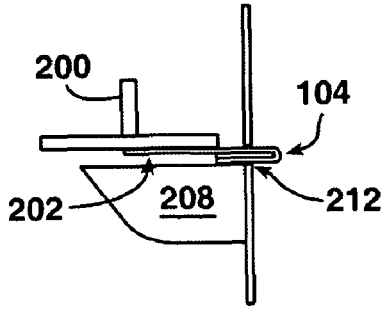

As shown in FIG. 9B, the vacuum platen 200 is brought into close proximity to a folding arm 208 so that the migrating ink end of the time label 104 can be manipulated and folded over onto the adhesive of the time label. The vacuum platen 200 holds only a portion of the time label 202 so that it can keep the migrating ink end of the time label 202 unsupported for manipulation purposes.

As shown by progressive movements of the folding arm relative to the time label, FIG. 9 B, C, D, E, F, the time label is folded along the edge of the liner 104 that is held in position by the vacuum platen 200. The time label 202 may be perforated along this fold line in order to facilitate the folding process. In performing this operation, the migrating ink adheres to the adhesive of the time label and initiates the dye migration so that the time label is activated and will change color after its prescribed time. In the final stage of folding as shown in FIG. 9F, the vacuum platen 200 supports the label 202 while the folding platen 208 presses the migrating ink folded area onto the adhesive to insure a tight bond. The activated time label can then be passed through the issuing slot 212 of the printing device for removal and use by the recipient.

These mechanical activating mechanisms are but a few of the many arrangements that can be conceived for folding over adhesive labels such as the time label. Another folding mechanism that could be used to print and activate these time labels is one which presents the time label within the adhesive facing up at the exit slot 212. In this design, the label web is drawn over an inverted sharp angle where the time label is released and the vacuum platen is below the time label. Thus, holding the label adhesive facing up would provide a benefit that if the time label is not removed from the exit slot 212 immediately, the adhesive would only be exposed to air and thus, not encounter a sticking problem within the machine. The individual, such as a visitor, can pick up the time label (now a time-expiring visitor badge) with their fingers at any future time from the printer or kiosk.

The color changing time label shows its color change by developing a color area along the top or bottom edge of the badge. This is particularly beneficial for viewing by the human eye because the color bar extends horizontally. In designing standard visitor or other temporarily identification badges, this horizontal band is beneficial because it provides an area for printing the date or the day code so that this time-indication information is easily colored and provides an important means of identify valid identification badges.

There are numerous benefits:

- Migrating ink on the edge design may be better than the interior fold over design because it is easier for automated mechanically folding activation
- Symmetrical two edge design permits machine fold-over for activation by applying equal force opposed to each other
- Self-folding of an adhesive label along the top edge of a time label as described may provide a superior, less failure prone, device for printing, activating, issuing
- A time label with all the chemical ingredients, dyes, etc contained within single label construction itself A time label with only one supply (replacement) item—the roll of labels Time labels which permit easy hand activation Time labels without chaff Time labels that can be printed, activated & issued in one step Time labels can be issued with the liner removed (and having the adhesive exposed and the label ready to apply to ones clothing).

Time labels of this type permit years of shelf-life

Device to issue (and print) activated time labels which requires no heater adjustments or setting, no ribbons, no inkjet or toner supplies, no ambient temperature adjustments A construction of a time label that is tamper resistant because once the migrating ink touches the adhesive, it cannot be lifted off or stopped.

A time label system where the time labels can be issued both by hand or by a machine. If the machine breaks or there is no power, time labels still work such as a disaster scene or emergency site.

A fold-over activation means which eliminates complicated mechanical mechanisms

Different times for time labels can be accomplished by simply supplying different time label stock. No machine adjustment needed.

Different size labels do not require different ribbons or liquids in these machines.

While various changes may be made in the detailed construction and processes of this invention, it will be understood that such changes will be within the spirit and scope of the present invention. Having thus described the invention in detail, it is to be understood that the foregoing description is not intended to limit the spirit and scope thereof. What is desired to be protected by Letters Patent is set forth in the appended claims.

What is claimed is:

1. A self-expiring badge or label comprising:

an upper substrate having an upper surface and a lower surface, an adhesive activator layer on the lower surface, a protective layer having a first surface and a second surface, the first surface removably attached to and overlaying the adhesive layer, a migrating ink pattern on the second surface of the protective layer, whereby removing the upper substrate and at least a portion of the protective layer leaves a remaining portion having the migrating ink pattern thereon, and contacting the migrating ink pattern to the exposed adhesive activator layer on the lower surface of the upper substrate to activate the migrating ink pattern to migrate through the adhesive activator layer and upper substrate in a selected time interval for viewing from the upper surface of the upper substrate layer to indicate an expired badge or label.

2. The self-expiring badge or label of claim 1, wherein the migrating ink pattern is contacted to a portion of the exposed adhesive activator layer, the remaining portion of the exposed adhesive activator layer for adhesively mounting the badge or label to a surface.

3. The self-expiring badge or label of claim 1, wherein the remaining portion of the protective layer having the migrating ink pattern thereon is folded to contact the migrating ink pattern to the exposed adhesive activator label.

4. The self-expiring badge or label of claim 1, wherein the remaining portion of the protective layer having the migrating ink pattern thereon is folded to contact the migrating ink pattern to a portion of the exposed adhesive activator layer, the remaining portion of the exposed adhesive activator layer for adhesively mounting the badge or label to a surface.

* * * * *